United States Patent [19]

Vansant

[11] 4,394,634

[45] Jul. 19, 1983

[54] VAPOR COOLED CURRENT LEAD FOR CRYOGENIC ELECTRICAL EQUIPMENT

[76] Inventor: James H. Vansant, Tracy, Calif., granted to U.S. Department of Energy under the provisions of 42 U.S.C. 2182

[21] Appl. No.: 314,918

[22] Filed: Oct. 26, 1981

[51] Int. Cl.[3] ..... H01F 7/22

[52] U.S. Cl. ..... 335/216; 174/15 CA

[58] Field of Search ..... 335/216; 174/15 C, 15 CA, 174/15 S

[56] References Cited

U.S. PATENT DOCUMENTS 3,527,873 9/1970 Brechna et al. ..... 174/15

3,946,142 3/1976 Kellow et al. ..... 174/15

OTHER PUBLICATIONS

I.E.E.E. Transactions on Magnetics, vol. MAG-11, No. 2, Mar. 1975, "Flow Instabilities in Gas-Cooled Cryogenic Current Leads".

Cryogenics, Mar. 1976, entitled "Negative Differential Flow Resistance in Super Critical Helium", by V. Arg.

*Primary Examiner*—George Harris

*Attorney, Agent, or Firm*—L. E. Carnahan; William H. F. Howard; Richard G. Besha

[57] ABSTRACT

Apparatus and method are provided for conducting electric current to cryogenic electrical equipment devices. A combination of inner and outer tubes together form a plurality of hollow composite tubes housed in a sheath. Top and bottom block mounting means are fitted to hold the composite tubes and are affixed to the ends of the sheath. This combination forms a current lead. The current lead is attached to a cryogenic device housing a fluid coolant which moves through the current lead, cooling the current lead as the fluid travels.

17 Claims, 4 Drawing Figures

VAPOR COOLED CURRENT LEAD FOR CRYOGENIC ELECTRICAL EQUIPMENT

FIELD OF THE INVENTION

The Government of the United States of America has rights in this invention pursuant to Department of Energy Contract W-7405-ENG-48 between the U.S. Department of Energy and The University of California for the operation of Lawrence Livermore National Laboratory.

This invention relates generally to current leads which conduct electric current to devices powered by electricity, and more particularly to vapor cooled current leads for cryogenic electrical equipment.

BACKGROUND OF THE INVENTION

Cooled current leads are now being used. U.S. Pat. No. 3,946,142 issued Mar. 23, 1976 to M. Kellow et al entitled "Cooling of Power Terminals Utilizing an Open Cycle Cooling System" discloses an apparatus for cooling underground power cables. This patent is incorporated herein by reference. In the Kellow et al patent, the apparatus comprises a chamber adapted to enclose a length of underground power cables. Liquid and vapor are provided to cool the cables. In various "stations", a cooling fluid is pumped around a portin of the outside of the cable as well as through that portion of the cable contained within the "station" with water being the cooling fluid used.

U.S. Pat. No. 3,257,873 issued Sept. 8, 1970 to H. Brechna et al entitled "Composite Superconducting Cable in a Porous Matrix" discloses a composite superconducting cable supported in a conduit by means of a porous matrix provided with a main channel for circulation of a coolant through the cable. This patent is hereby incorporated by reference. In the Brechna et al patent, the porous matrix both supports the superconducting wire and at the same time permits penetration of coolant directly to the wire. A cryogen in a super critical state is circulated through the cable, moves through the porous matrix and penetrates directly through the superconducting wires and removes heat. The cooling fluid washes around the outside of the solid superconducting wire.

The above two patents are inadequate for providing solutions to the problems from which the invention described herein arose. The specific problems of the prior art were: (1) how to provide electric current to a superconducting electromagnet through a current lead which would not transmit heat from the outside atmosphere to the superconducting electromagnet, and (2) how to provide a current lead which had means for dissipating Joule heating occurring within the current lead as the electric current passed through the lead.

The phenomenon of superconductivity i.e., zero electrical resistance, is produced commonly by cooling a superconducting alloy such as niobium-tin or niobium titanium, below a critical temperature. For the most common superconducting alloys, the critical temperature is 18° K. or less and may be achieved with a liquid cryogen coolant, such as liquid helim which has a temperature of 4.2° K. under standard atmospheric conditions. However, the actual operating temperature of a particular superconductor is influenced by several factors, including the amount of current flowing in the conductor, the magnitude and rate of change of any magnetic fields to which the conductor is subjected. In particular, current conduction above a critical level causes a temperature rise in the conductor due in part to Joule heating; this results in a partial loss of zero resistance, thereby producing localized heating.

Since the normal resistance of superconductors is realatively high compared to copper or aluminum at cryogenic temperatures, any rise of the temperature of the conductor above the critical level causes local heating which may result in heating of adjacent areas and eventually the entire conductor. When this happens, the superconductor reverts from zero resistivity to its normal resistance, causing Joule heating in the conductor. Due to the high "normal resistance" (i.e. the inherent resistance of the alloy at non-superconducting temperatures) of superconducting alloys, the temperature may become so high as to destroy the conductor.

Vapor cooled current leads are presently being used to supply electric current to superconducting electromagnets. In one apparatus now in use, enclosed in a shell is a bundle of parallel electrical conductors which are hollow in the center throughout their length. The conductors of this apparatus are made of copper alone and bundled together inside the shell. The inside ends ("cold ends") of these conductors are inserted into and joined to the superconducting electromagnet, and cooled by evaporating a liquid cryogenic coolant into a vapor which passes through the hollow centers of the conductors. The current leads are electrically connected to an external current force. As current moves from the current source through the conductors into a superconducting electromagnet, heat is generated by Joule heating which is of sufficient magnitude to melt the tubes if the tubes are not cooled. Cooling is provided by flowing the vapor coolant originating from inside the superconducting magnet into and through the conductors, the coolant absorbing heat from the tubes and venting through ports provided at the outside end of the shell toward the outside end ("warm end"), and also through the hollow centers of the tubes.

If there is a loss of coolant flowing through the tubes carrying the current, in approximately five minutes the tubes will experience thermal failure, thereby stopping the flow of current through the superconducting electromagnet. Because of the nature of operation of superconducting electromagnets, such a sudden loss of current would severly damage if not destroy superconducting electromagnets. The problem became one of extending the period of time it took the current leads to heat up enough to experience thermal failure, thereby permitting a greater period of time over which the current can be gradually reduced to "turn off" the superconducting electromagnet without a catastrophic failure. Up until the time of the invention disclosed herein, there has been no sufficient way to deal with this problem.

SUMMARY OF THE INVENTION

In order to resolve the above problems as well as others, it is a general object of this invention to provide apparatus and method for supplying electric current to a device designed to receive electric current.

Another object of this invention is to provide apparatus and method for supplying electric current, which device is a current lead that is cooled.

Another object of this invention is to provide apparatus and method for supplying electric current to a device being operated at superconducting cryogenic temperatures.

Another object of this invention is to provide apparatus and method for supplying electric current to a superconducting electromagnet through a current lead provided with internal conduits which permit a cooling fluid to move through the current lead to provide heat transfer in order to prevent heat buildup.

Other objects of the invention will become apparent through the example provided by the following detailed description of a preferred embodiment when read in conjunction with the accompanying drawings, as well as the Example following the detailed description.

To satisfy these and other objects, this invention in summary provides apparatus and method for conducting electric current to and from cryogenic electrical equipment, which comprises:

(a) a plurality of inner tubes, each having an inside end and outside end, provided with internal conduits substantially traversing the length of said tubes and penetrating said inside and outside ends, said inner tubes being arranged generally parallel to one another in substantially adjacent relation and capable of conducting and transferring electric current and heat;

(b) a plurality of outer tubes substantially encasing said inner tubes, said outer tubes having inside ends and outside ends defining openings in themselves, said outer tubes being capable of conducting and transferring electric current and heat, and being in heat-conducting and electricity-conducting communication with said inner tubes, said inner tubes and outer tubes together forming a plurality of composite tubes;

(c) a sheath provided with an inside and outside end, defining a channel through itself which penetrates said inside and outside ends, said sheath being mounted to encase said plurality of composite tubes in a bundled arrangement forming apparatus capable of conducting and transferring electric current and heat;

(d) top and bottom block mounting means fitted to hold said composite tubes, said mounting means being fixedly held on said ends of said sheath in such relation that the combination of the sheath and mounting means define a chamber capable of sealably holding said composite tubes, said mounting means adapted to receive, conduct and transfer electricity and heat, said sheath, mounting means and composite tubes being combined for creating an electric current lead;

(e) vent means, located toward said outside end of said sheath, penetrating said sheath;

(f) cryogenic electrical equipment device, capable of being operated by electric current;

(g) cryogenic cooling means, housed within and cooling said device; and (h) means for connecting the inside end of said current lead to said device, so said internal conduits of said composite tubes are in fluid communication with said cooling means so said cooling means is free to move from the inside of said device through said internal conduits of said composite tubes toward said outside end, emerging through said vent means and said outside ends of said composite tubes, cooling said composite tubes and said current lead as the cooling means travels from said inside end toward said outside end and vent means.

The novel features of this invention are set forth with particularity in the appended claims. The invention will best be understood from the example set forth by way of the following detailed description of a preferred embodiment when read in conjunction with the accompanying drawings.

DETAILED DESCRIPTION OF A PREFERRED EMBODIMENT

Figure 1:
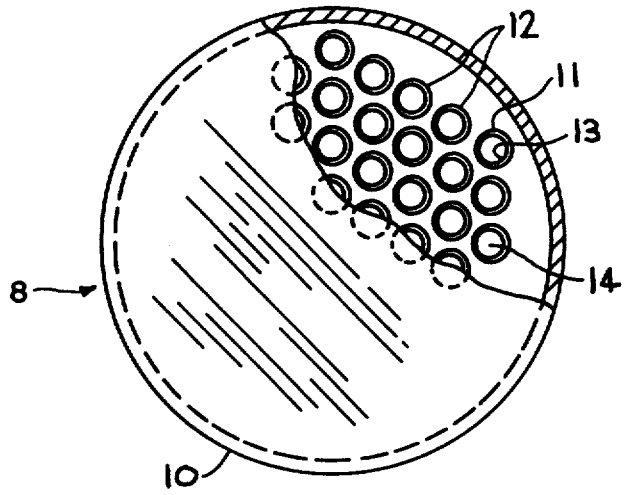
FIG. 1 is a cross-section of the current lead, in accordance with one arrangement according to a preferred embodiment.
Figure 2:
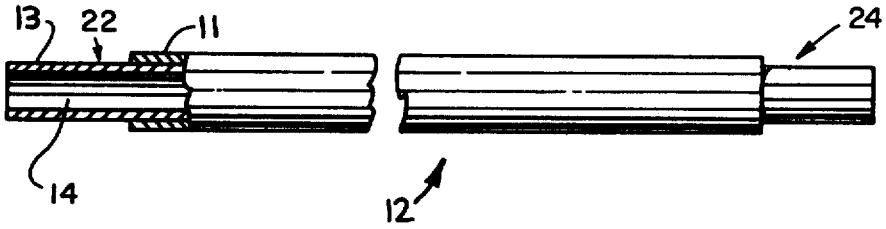
FIG. 2 shows one composite tube, partially cut away to show the inner and outer tubes, in accordance with one arrangement of a preferred embodiment.
Figure 3:
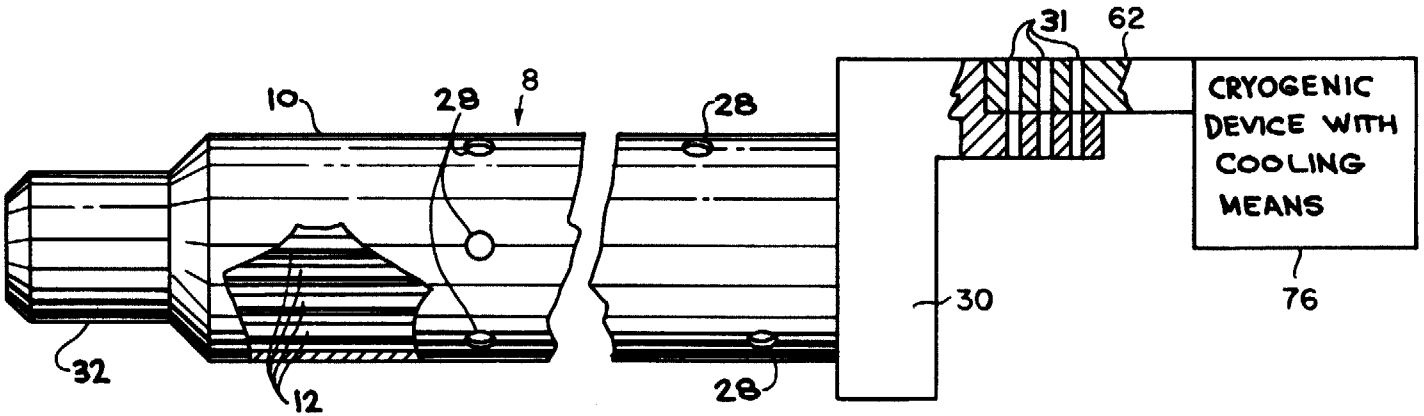
FIG. 3 is a partial cut-away view of the current lead when viewed from the side, in accordance with one arrangement of a preferred embodiment.

FIGS. 1, 2, 3, and 4 provides an example of a preferred construction of an apparatus using this invention to achieve optium performance in accordance with the claims, although other constructions are possible. Referring to the FIG. 1 cross section of the current lead, it can be seen that sheath 10 encloses the bundle consisting of composite tubes 12 formed by wrapping outer tube 11 around inner tube 13 so that they are in heat conducting relation and electricity conducting relation with each other. As shown in FIG. 2, composite tubes 12 have an inside end 24 which is disposed inside the superconduction magnet, and outside end 22 which is exterior to the superconducting magnet. The composite tubes 12 as shown in FIG. 3 are then securely attached respectively to bottom block 30 and top block 32. Housed in each composite tube 12 is an internal conduit 14, spanning the length of composite tubes 12 and penetrating through the outside end 22 and inside end 24. The composite tubes 12 are mounted on bottom block 30 and top block 32 so the internal conduits 14 penetrate the blocks. Sheath 10 which encloses the bundle consisting of composite tubes 12, is firmly secured to bottom block 30 and top block 32, and is provided with vents 28 which penetrate sheath 10 such that fluid can pas through vents 28. The thus assembled current lead 8 is mounted to penetrate the side of a superconducting electromagnet in such a manner that bottom block 30 resides inside the device (not shown) receiving the electric current, and with top block 32 external to the device.

FIG. 2 shows a single composite tube 12 according to this preferred embodiment. Outer tube 11 is slipped over inner tube 13; the two tubes are swaged together sufficiently to be in electric current conducting relation and heat conducting relation with each other. Internal conduit 14, as previously mentioned, is provided inside inner tube 13 and spans inner tube 13's length to penetrate inside end 24 and outside end 22. Inside end 24 is then firmly mounted in and penetrates bottom block 30 (see FIG. 3), and outside end 22 is firmly mounted on and penetrates top block 32.

During operation, outside end 22 of composite tubes 12 reside in top block 32 which is electrically connected to a current source (not shown) external to the superconducting electromagnet. Inside end 24 of composite tubes 12 residing in bottom block 30 are electrically connected to the superconducting electromagnet (not shown) by suitable standard electromagnet means. In this preferred embodiment, top block 32 and bottom block 30 are both capable of conducting electric current and heat, as is the entire current lead 8 and its parts as enumerated. Internal conduit 14 opens at inside end 24 of composite tube 12 into the superconducting electromagnet atmosphere containing a cryogenic fluid in both liquid and vapor phases. Inside end 22 is mounted in such a way that it is not in physical contact with the superconducting liquid but is in fluid communication with the vapor phase of the cryogenic liquid.

In FIG. 3, an electric current enters through outside end 22 and top block 32, travels along the length of composite tubes 12 and sheath 10 of current lead 8 continues through inside end 24 and into the superconducting electromagnet (not shown). In this preferred embodiment, inner tube 13 consists of copper, but other suitable electrical conductors would suffice. The flowing electric current generates heat by Joule heating which must be dissipated in order to prevent thermal failure of the inner tubes 13. Cooling is provided by inserting inside end 24 into the superconducting electromagnet so internal conduits 14 are in fluid communication with the vapor phase of the cryogenic coolant, but not in contact with the liquid phase of the cryogenic coolant. The vapor phase of the cryogenic coolant (not shown) moves from the superconducting electromagnet, through inside end 14 into internal conduit 26 of inner tube 13, and moves toward outside end 22 absorbing heat from inner tube 13 as it travels. The cooling vapor also flows along the outside of composite tubes 12 and inside sheath 10, to emerge through vents 28.

To extend the period of time during which the current lead 8 can still supply current to the superconducting electromagnet without experiencing thermal failure resulting from loss of coolant, outer tube 11 is wrapped around inner tube 13. The material for outer tube 11 is selected to have high thermal capacity, i.e. outer tube 11 must have the ability to absorb large heat fluxes as well as have an integral resistance much greater than that of inner tube 13. In this preferred embodiment, the outer tube material is stainless steel.

FIG. 3 shows the assembled current lead 8. As can be seen, composite tubes 12 are bundled and housed inside sheath 10, bottom block 30 and top block 32 are attached to the inside and outside ends of sheath 10 and compostite tubes 12, such that internal conduit 26 (see FIG. 2) are in electricity-conducting and heat-conducting relation with bottom block 30 and top block 32, and penetrate the blocks. Vents 28 provided in sheath 10 permit flow-through of the coolant vapor (not shown). In this preferred embodiment, bottom block 30 resides within the housing of the superconducting electromagnet; top block 32 resides in an environment that is warm relative to the temperature inside the superconducting electromagnet. As can be seen in FIG. 3, FIG. 1 is a cross section of current lead 8 taken along the line 1—1 of FIG. 3. Copper bus 62 is attached at one end to bottom block 30 by attachment means such as bolts (not shown) fitted through openings 31. Copper bus 62 is attached at its other end to a cryogenic device 76 containing a cryogenic cooling means such as liquid helium (not shown).

Figure 4:
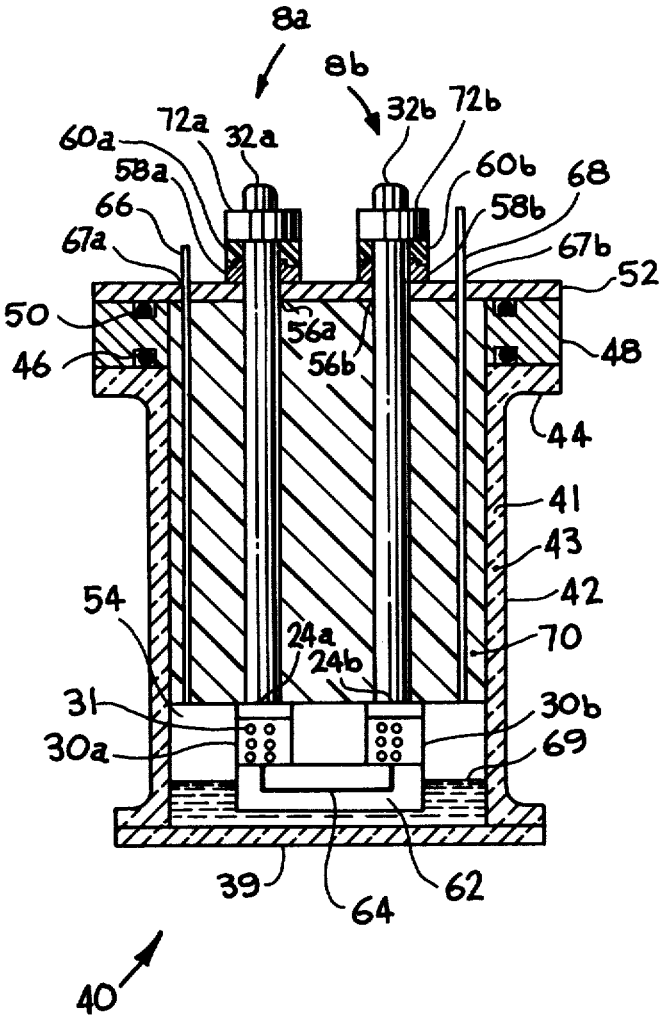
FIG. 4 is a schematic drawing showing how two current leads could be arranged to achieve the results according to one arrangement of the preferred embodiment, as further amplified by the Example below.

FIG. 4 is a schematic drawing of the current lead apparatus 40 housing two identical current leads as fabricated according to FIGS. 1, 2, and 3. This embodiment uses two current leads identical to lead 8 of FIG. 3 and are indicated at 8*a* and 8*b*. Current lead 8*a* and 8*b* are mounted generally parallel to one another and are electrically insulated from each other. Current leads 8*a* and 8*b* have an identical construction; the same splitting of identical numbered parts into "a" and "b" is done with other components as appropriate as enumerated below.

FIG. 4 is a Test Apparatus easily adaptable for actual use in a cryogenic electrical equipment device. Wall 42 is formed into a cylinder; it could also have other geometries, for example, wall 42 could be formed into the shape of a rectangular box. Attached to the bottom of wall 42 is removable base 39. Wall 42 defines a hollow space 41 inside itself which is filled with a suitable cryogenic insulation 43. Space 41 is then pumped to vacuum pressure and the sealed. Wall 42 is rovided with a lip 44 toward the end of the wall approaching top block 32. Lip 44 protrudes outwardly from the center line of the cylinder formed by wall 42 and base 39, has a flat upper surface, and spans the circumference of the cylinder formed by wall 42 and base 39. Seal 46, here in the space of an O-ring, rests on top of lip 44; extension ring 48, also having an O-ring shape, is placed on top of seal 46. Ring 50, having generally a geometry similar to seal 46, is placed on top of extension ring 48, followed by flange 52. Suitable sealing means such as bolts or welding (not shown) are used to tightly seal together lip 44, seal 46, extension ring 48, ring 50, and flange 52 to form an assembly which, in conjunction with wall 42 and base 39, form chamber 54 having a sealed cylindrical chamber configuration.

Provided in flange 52 are ports 56*a* and 56*b*, through which current leads 8*a* and 8*b* are inserted. On top of and adjacent ports 56*a* and 56*b* are placed support seals 58*a* and 58*b*, followed by ring-shaped insulation 60*a* and 60*b* which rest against the underside of top blocks 32*a* and 32*b* of current leads 8*a* and 8*b*. At the inside ends 24*a* and 24*b* of current leads 8*a* and 8*b*, bottom blocks 30*a* and 30*b* are securely attached. A copper bus 62 is attached to the bottom side of bottom blocks 30*a* and 30*b* by attachment means such as bolts (not shown) which are fitted through a plurality of openings 31 provided in bottom blocks 30*a* and 30*b*. Residing in the copper bus is superconductor 64, which in this Example of a preferred embodiment is comprised of niobium-tin.

Through tube 66 liquid helium flos into chamber 54 up to the dashed line liquid helium level 69 to completely submerge superconductor 64 and partially submerge copper busses 62*a* and 62*b*. Tube 66 is inserted through inlet 67*a* provided in flange 52. Also provided in flange 52 is inlet 67*b* through which is inserted vent 68, a hollow tube that permits helium vapor to escape from chamber 54 as the liquid helium vaporizes. Insulator 70, preferably comprised of rigid foam insulation, is packed into the remaining areas of chamber 54 spanning from inside end 24*a* and 24*b* up to and in contact with flange 52, also in contact with wall 42, tube 66 and vent 68, and current leads 8*a* and 8*b*, thus providing thermal and electrical insulation. Bus clamps 72*a* and 72*b* are electrically connected to top blocks 32*a* and 32*b*, the bus clamp 72*a* supplying the input current and the bus clamp 72*b* providing the outlet for the electric current.

The current lead apparatus 40 described above and in FIG. 4 shows the Test Apparatus configuration. For actual use in the superconducting electromagnet or other cryogenic electrical equipment device, base 39 would be removed to reveal the bottom ends of bottom blocks 30*a* and 30*b* and insulator 70. Tube 66 and vent 68 would be removed, as would be the superconductor 64. Two copper busses similar to bus 62 would be attached electrically and mechanically to bottom blocks 30*a* and 30*b* and would run to and be attached to the superconducting electromagnet or other cryogenic electrical equipment device 76. Also absent would be the liquid helium of this Example represented by the liquid helium level 69-line, at least in this configuration. However, some form of cryogenic fluid would be contained in the cryogenic electrical equipment, contacting the superconductor attached to the copper busses.

This invention has much broader application than disclosed in this preferred embodiment, which limits itself to a description of the invention as applied to superconducting electromagnets containing cryogenic fluid (in either or both liquid and gas phases). However, the device could be any type of cryogenic electrical equipment.

While a preferred embodiment of the invention has been described and shown, and an Example apparatus and method are discussed next below, further embodiments and combinations as described herein will be apparent to those skilled in the art without departing from the spirit of the invention, or from the scope of the appended claims.

EXAMPLE

In this Example, the design dimensions of the various components of the vapor cooled current leads (VCL) actually fabricated are given, although many other designs and configurations could conceivably be devised by those skilled in the art to which this invention pertains. Referring to FIG. 1, the distance between center lines on the vertical axis for the composite tubes 12 is 0.147 inches; the horizontal spacing is 0.254 inches between the center line of the composite tubes. The VCL of the design contained in this example includes stainless steel outer tubes that are swaged around each copper inner tube to increase the thermal capacity of the VCL. The copper inner tube 13 has a 6.35 mm outside diameter (0.25 inches) with a wall thickness of 0.635 mm (0.025 inches); the outer tubes 11 were made from stainless steel having dimensions of 7.94 mm outside diameter (0.3125 inches) and a wall thickness of 0.51 mm (0.020 inches). The copper-stainless steel composite tubes 12 are housed in a sheath 10 made of stainless steel having dimensions of 73.03 mm outside diameter (2.875 inches) and a wall thickness of 1.65 mm (0.065 inches). Materials other than steel and copper were considered for the VCL.

It is preferable that most of the electric current flow through the copper (inner tube 13) and very little flow through the stainless steel (outer tube 11). The reason for this has to do with the electrical resistance rations of the material of inner tube 13 and outer tube 11. It is desirable to have a high ratio of stainless steel-to-copper electrical resistance to encourage the electric current to "prefer" flowing through the copper instead of through the stainless steel. In current lead 8, most of the electric current flows through the copper inner tube 13 and very little current flows through the stainless steel outer tube 11. This is because copper has an electrical resistance to current flow which is much less than the electrical resistance of stainless steel.

The problem with substituting other materials for copper—in this case, both phosphorized copper and 70-30 brass were considered—is that these materials have a resistance higher than copper's resistance. Because this resistance is higher, the electrical resistance ratio between stainless steel and phosphorized copper (as well as 70-30 brass) goes down. This is undesirable because by decreasing the electrical resistance ratio between the outer tube 11 (stainless steel) and inner tube 13 (by using phosphorized copper or 70-30 brass), relatively more electric current flows through the outer tube 11, which is undesirable. Additionally, cryo-instabilities may occur in current leads made from these materials because the leads would be much shorter than the final length selected.

OFHC-101 copper is a good choice for the inner tubes 13 of the VCL. The length of the inner tubes 13 is 62.60 inches of copper; the outer tube 11 has a length of 58.00 inches and is swaged around the copper inner tube 13 in a position so that 2.30 inches of copper inner tube 13 are left exposed at both the outside end 22 and inside end 24 (see FIG. 2). A total of 61 composite tubes in this Example were sealed inside sheath 10. As shown in FIG. 4, two current leads (designated as current lead 8*a* and current lead 8*b* in FIG. 4 as discussed in the detailed description) are housed in chamber 54 defined by and residing inside wall 42. In the hollow space 41 provided inside wall 42 is a suitable cryogenic insulation 43. For this Example construction, approximately one hundred (100) layers of 0.5-mil thick aluminized mylar film is "sandwiched" in layers to form this cryogenic insulation. Space 41 is then evacuated to form a vacuum; wall 42 is then sealed. The insulator 70, in this case constructed of rigid foam, is fitted into chamber 54 in contact with wall 42 and current leads 8*a* and 8*b*.

As configured according to this Example, the allowed delay time permitted before current flow would have to be stopped in the current lead to avoid thermal failure is approximately 20 minutes for a maximum temperature of 400° K.; this is considerably more than the specified minimum 10 minute delay time required. Consequently, this design has sufficient margin to compensate for uncertainties of behavior or properties.

Current leads are a critical component of superconducting magnet systems. They are essential for control and protection of the magnets. Failure of a current lead, in this case a vapor cooled current lead (VCL) would result in severe damage to the superconducting electromagnet. Therefore, it is crucial that the current leads have good reliability; to obtain this desired reliability as chosen and illustrated as this Example, some thermal performance has been sacrificed to achieve the design objective, i.e., that heat transfer to the cryogenic coolant liquid helium (LHe) be more than the heat transfer from the optimum VCL. The inner tubes 13 are constructed from copper tubes which were then joined to bottom block 30 and top block 32, also constructed of copper; the copper tubes were connected by a high temperature braze to the top and bottom blocks.

Inner tubes 13 are used for current flow and fluid coolant gaseous helium (GHe) transfer from the inside of the superconducting electromagnet outside of current lead 8. The top and bottom blocks are for connecting electric current-carrying bus clamps 72*a* and 72*b* at one end (in this design to top blocks 32*a* and 32*b*), and a superconducting bus 64 at the other end (in this example bottom blocks 30*a* and 30*b*). The copper tubes (inner tubes 13) are sheathed with stainless steel tubes (outer tubes 11) that contribute mainly to thermal performance of current lead 8 during accidental loss of cryogenic helium flow. A large stainless steel tube (sheath 10) encases the bundle of composite tubes 12 for additional strength and protection. All of the tubes are of standard size and commercially available. The design provided by this example is both rugged and reliable.

Design current of the VCL is 6,000 amps. The maximum operating current for the superconducting electromagnets for which the VCL was developed is 5,775 amps. The cryogenic coolant gaseous helium (GHe) flow for the design of this Example allows for as much as 0.6 grams/second for each VCL. An optimum VCL rated at 6,000 amps would require less than 0.3 grams/-second. Thus, a GHe flow of 0.4 grams/second through each VCL was chosen for operating at 6,000 amps because this flow rate is a reasonable value for reliable performance under these circumstances.

Selected operating temperatures for the VCL are 4.5° K. at the "cold end" (bottom block 30), and 300° K. at the "warm end" (top block 32). The GHe enters the VCL at 4.5° K. at inside end 24; its exit temperature at outside end 22 being 285° K. so as to provide sufficient temperature difference for good conduction heat transfer from the superconducting magnet toward the outside end 22 of current lead 8. The temperature at inside end 24 is maintained by GHe flow and heat conduction through the copper bus (bottom block 30) from the LHe that is a few centimeters below the bottom of inside ends 24 of composite tubes 12 of the VCL. The temperature at inside end 24 is chosen to be sufficient to prevent condensation of water vapor on sheath 10 of the VCL.

In the event of loss of GHe flow through a VCL, a superconducting electromagnet protection system (not shown) will detect this malfunction and initiate a fast dump of electric current after a selected delay time. The VCL temperature will increase to a maximum value dependent on this selected delay time and on the current dump time. What has been selected is a design requirement of 400° K. maximum temperature for a 10 minute delay before totally shutting off the current flow to the superconducting electromagnet, and 6,000 amps operating current. The 10 minute delay is adequate time to detect the malfunction of a cutoff in operating current, and permits either the taking of corrective action, or permits sufficient time to perform a "fast dump" of electric current from the superconducting electromagnet. The 400° K. limit is well within the VCL capability to operate without damage or failure. The design of the VCL provides sufficient thermal mass to satisfy this 400° K. temperature limit requirement.

If a VCL is not properly designed, flow instabilities which are unique to cryogenic systems will develop and greatly increase the heat transfer into the LHe. Such flow instabilities in cryogenic systems are more thoroughly discussed in a publication by P. Thullen entitled "Flow Instabilities in Gas Cooled Current Leads," IEEE Transactions on Magnets, Volume MHE-11, Number 2, March 1975, pages 572 through 578, and a publication by V. Arp entitled "Negative Differential Flow Resistance in Supercritical Helium" published in "Cryogenics" in March 1976, pages 171-177. Both of these articles are hereby incorporated by reference. This phenomenon can occur under certain conditions, e.g., gas flow is too low, or helium inlets are too near the thermodynamic critical point, or the current lead is too short, current heat flux rates to the vapor are too high, or the inlet temperature is too low. In the Example here, the VCL has been designed so none of these conditions occur. Additionally, vent holes (in this case, vents 28) are included in the large stainless steel sheath 10 so that the longitudinal spaces between the small stainless steel/copper composite tubes 12 will not become channels for unstable gas flow. Moreover, the GHe will help to laterally equalize temperatures and inhibit instabilities.

I claim:

1. Apparatus for conducting electric current to and from cryogenic electrical equipment, which comprises:

(a) a plurality of inner tubes, each having an inside end and outside end, provided with internal conduits substantially traversing the length of said tubes and penetrating said inside and outside ends, said inner tubes being arranged generally parallel to one another in substantially adjacent relation and capable of conducting and transferring electric current and heat;

(b) a plurality of outer tubes substantially encasing said inner tubes, said outer tubes having inside ends and outside ends defining openings in themselves, said outer tubes being capable of conducting and transferring electric current and heat, and being in heat conducting and electricity conducting communication with said inner tubes, said inner tubes and other tubes together forming a plurality of composite tubes;

(c) a sheath provided with an inside and outside end, defining a channel through itself which penetrates said inside and outside ends, said sheath being mounted to encase said plurality of composite tubes in a bundled arrangement forming apparatus capable of conducting and transferring electric current and heat;

(d) top and bottom block mounting means fitted to hold said composite tubes, said mounting means being fixedly held on said ends of said sheath in such relation that the combination of the sheath and mounting means define a chamber capable of sealably holding said composite tubes, said mounting means adapted to receive, conduct and transfer electricity and heat, said sheath, mounting means and composite tubes being combined for creating an electric current lead;

(e) vent means, located toward said outside end of said sheath, penetrating said sheath;

(f) cryogenic electrical equipment device, capable of being operated by electric current;

(g) cryogenic cooling means, housed within and cooling said device; and, (h) means for connecting the inside end of said current lead to said device, so said internal conduits of said composite tubes are in fluid communication with said cooling means so said cooling means is free to move from the inside of said device through said internal conduits of said composite tubes toward said outside end, emerging through said vent means and said outside ends of said composite tubes, cooling said composite tubes and said current lead as the cooling means travels from said inside end toward said outside end and vent means.

2. The apparatus according to claim 1 wherein said inner tubes are constructed of copper.

3. The apparatus according to claim 1 wherein said outer tubes are constructed of stainless steel which is capable of providing structural support for said inner tubes and said current lead, and capable of providing increased thermal capacity for said inner tubes and said current lead.

4. The apparatus according to claim 1 wherein said mounting means is constructed of a dielectric material provided with an opening through which at least one electrical conductor can be fitted to pass.

5. The apparatus according to claim 1 wherein said mounting means is constructed of a material capable of conducting electricity.

6. The apparatus according to claim 1 wherein said current lead is held at a pressure equal to that of said cooling means and is in fluid communication with said cooling means.

7. The apparatus according to claim 1 wherein said device is a superconducting electromagnet.

8. The apparatus according to claim 1 wherein said cooling means comprises helium in the form of cryogenic liquid and vapor.

9. The apparatus according to claim 1 wherein said device is a superconducting electromagnet, which is sealed so said superconducting electromagnet will house said coolant fluid inside itself and maintain a pressure outside itself.

10. The apparatus according to claim 1 wherein said chamber formed by said sheath and said mounting means is in pressurized equilibrium with said coolant fluid entering said current lead.

11. Method for conducting electric current to and from at least one cryogenic electrical equipment device, comprising the steps of:

(a) providing at least one internal conduit inside at least one inner tube formed of material capable of conducting electric current and heat, said internal conduit being capable of permitting passage of fluid;

(b) enclosing at least one of said inner tubes in at least one outer tube, which is in electrical conducting relation and heat conducting releation with said inner tube, the combined said inner and outer tubes creating at least one composite tube;

(c) providing a cryogenic electrical equipment device which is operated at least in part by electric current;

(d) connecting said current lead between and to at least one electric current source and said device; and, (e) flowing at least one fluid through said internal conduit, said fluid experiencing a heat exchange interaction with said inner tube as said fluid travels.

12. The method according to claim 11 wherein said inner tube material is copper.

13. The method according to claim 11 further comprising the step of step (c) by providing a device which is a superconducting electromagnet housing circulating helium, said helium being at cryogenic temperatures.

14. The method according to claim 11 further comprising the step of using cryogenic helium as said fluid wherein said cryogenic helium is evaporated from liquid helium to gaseous helium which then flows as gaseous helium through said internal conduits.

15. The method according to claim 11 further comprising the step of using stainless steel as the material for making said outer tube.

16. The method according to claim 11, additionally including the step of selecting a material capable of conducting an electric current for forming the one inner tube.

17. The method according to claim 16, additionally including the step of forming the selected material into at least one inner tube capable of conducting electric current and heat.

* * * * *